US006334613B1

(12) United States Patent
Yoseloff

(10) Patent No.: US 6,334,613 B1
(45) Date of Patent: Jan. 1, 2002

(54) MULTIPLE PAY POKER GAME

(75) Inventor: Mark L. Yoseloff, Henderson, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 09/394,818

(22) Filed: Sep. 13, 1999

(51) Int. Cl.[7] ..... A63F 1/00

(52) U.S. Cl. ..... 273/292; 273/274; 273/138 A; 463/13; 463/12

(58) Field of Search ..... 273/292, 274, 273/138 A; 463/13, 12

(56) References Cited

U.S. PATENT DOCUMENTS

| | | | | |
|---|---|---|---|---|
| 3,667,757 A | | 6/1972 | Holmberg | 273/135 G |
| 4,743,022 A | * | 5/1988 | Wood | 273/85 CP |
| 5,022,653 A | * | 6/1991 | Suttle et al. | 273/85 CP |
| 5,042,818 A | * | 8/1991 | Weingardt | 273/292 |
| 5,098,107 A | | 3/1992 | Boylan et al. | 273/292 |
| 5,265,882 A | * | 11/1993 | Malek | 273/292 |
| 5,288,077 A | | 2/1994 | Jones | 273/292 |
| 5,288,082 A | | 2/1994 | Marquez | 273/292 |
| 5,322,295 A | * | 6/1994 | Cabot et al. | 273/292 |
| 5,332,219 A | * | 7/1994 | Marnell, II et al. | 273/138 A |
| 5,356,140 A | | 10/1994 | Dabrowski et al. | 273/85 CP |
| 5,364,105 A | | 11/1994 | Jones | 273/292 |
| 5,377,993 A | | 1/1995 | Josephs | 273/292 |
| 5,395,120 A | | 3/1995 | Malek et al. | 273/292 |
| 5,415,404 A | * | 5/1995 | Joshi et al. | 273/138 A |
| 5,417,430 A | | 5/1995 | Breeding | 272/292 |
| 5,494,295 A | * | 2/1996 | Potter et al. | 273/292 |
| 5,531,440 A | | 7/1996 | Dabrowski et al. | 463/12 |
| 5,664,781 A | | 9/1997 | Feola | 273/292 |
| 5,697,614 A | * | 12/1997 | Potter et al. | 273/292 |
| 5,702,104 A | | 12/1997 | Malek et al. | 273/292 |
| 5,803,809 A | * | 9/1998 | Yoseloff | 463/13 |
| 5,816,915 A | | 10/1998 | Kadlic | 463/13 |
| 5,839,730 A | | 11/1998 | Pike | 273/292 |
| 5,863,041 A | | 1/1999 | Boylan et al. | 273/292 |

* cited by examiner

*Primary Examiner*—Jeanette Chapman
*Assistant Examiner*—Dolores R. Collins
(74) *Attorney, Agent, or Firm*—Mark A. Litman & Assoc. P.A.

(57) ABSTRACT

In the play of a hand of poker (either as a casino table card game or a video gaming apparatus or computer game), a partial hand is provided to a player after initial wager. The actual hand of poker involves the potential for at least two distinct games of poker being playable from that partial hand. The player may then elect to play one or more of the potential games from at least two distinct games of poker available for play with that hand. The nature of the at least two distinct games is that at least two of the games which may be played from the partial hand require decisions to be made where a decision with regard to a election of play strategy in one poker game that is intended to have or assist in getting a positive outcome is likely to have a negative effect or comprises an adverse strategy in the play of the second game. Various pay tables are provided that differ from each other, with respect to each single game, depending upon whether the player elects to play a single game with the partial poker hand or elects to play at least two games with continued play of the partial poker hand.

35 Claims, 3 Drawing Sheets

MULTIPLE PAY POKER GAME

BACKGROUND OF THE INVENTION

1. Field of the Invention

The present invention relates to a method of playing a wagering game utilizing standard rules and preferably a standard deck(s) of playing cards. More specifically, the method of the present invention is an enhancement to the game of poker which enables the potential for the contemporaneous play of at least two strategically different poker games at the same time.

2. Background of the Art

Many different wagering games presently exist for use in both home and casino environments. Such games should necessarily be exciting, uncomplicated and easy to learn so as to avoid frustrating the players. Card games such as poker and Twenty-One have gained widespread popularity because of their established ranking of hands and well known rules. Furthermore, each of these games usually involve continuous wagering opportunities for the players thus increasing player participation and excitement. Lastly, the games move fairly quickly to maintain action and activity. All of these factors have created games which are widely accepted and widely known.

Wagering games have been described in many previous publications such as U.S. Pat. No. 5,364,105 and U.S. Pat. No. 5,288,077. Both of these patents outline the addition of a progressive jackpot component to a Twenty-One game wherein wagers are received for participation in this jackpot component and these wagers are accumulated over a period of time to create a large jackpot. Following completion of a hand, the players may win a jackpot payout based on the final hand received by the player.

Variations in wagering structures can also increase the excitement and acceptance of such wagering games. U.S. Pat. No. 5,417,430 discloses a poker game with an altered wagering scheme thus allowing the player the opportunity to compete for an additional prize or payout.

Other variations can be made to standard games to allow more player opportunity and involvement. U.S. Pat. No. 5,098,107 discloses a game wherein additional symbols are added to increase wagering opportunities. This allows the player the opportunity to place several wagers on different portions of the game while the game is being played. Somewhat similarly, U.S. Pat. No. 3,667,757 discloses a board game wherein the player is given choices regarding alternative strategies for play. Naturally the different strategies chosen have different payoff results. Unfortunately, this game is somewhat complicated and requires a considerable amount of time for the players to learn.

In the play of a Twenty-One game, there are many well understood strategies for players to follow. One publication outlining these strategies is Jerry L. Patterson and Eddie Olsen "Break the Dealer", 1986, Putnam Publishing Group. Generally, this strategy involves the player surveying their dealt cards, the dealer's displayed card, and making appropriate decisions based thereon. For example, if a player has a card total of eleven (11), the player should take a hit regardless of the dealer's displayed card. If, however, the player has a card total of twelve (12), the player should then consider the dealer's displayed card. A hit should be taken if the dealer's displayed card is a 2, 3, 7–10 or Ace. Other cards displayed by the dealer will suggest much different decisions by the player.

Some twenty-one tables offer a side bet game called "Over-Under" or some variation thereof. In addition to the normal markings on the table which are desirable for play of twenty-one (designated spaces for cards, designated spaces for bets, etc.), tables where Over-Under are played also have two additional designated areas for bets. Usually the designated areas for the additional side bet is in the form of circles. Each circle identifies a specific bet, either "Over Thirteen" or "Under Thirteen." Before the turn of the first card in each hand of twenty-one, each player may place a bet as to whether the first two cards will total "Over Thirteen" or "Under Thirteen" by placing a bet in the appropriate circle. An amount of money equal to or less than the basic twenty-one wager may be placed in either circle. After the deal of the first two cards to each player, but before conclusion of the hand, wagers made on the side bet game of Over-Under have their wagers paid off or captured by the house. If the bet was Over Thirteen and the total of the cards was over thirteen, the house would pay equal odds on the wager. If the total count of the first two cards was thirteen or under, the house would capture the bet. Ties in this game (any total of thirteen) always allows the house to capture the bet. This side game has attained some level of acceptance and popularity, but payouts are limited to one-to-one ratios, with no special awards or multiplication of bets available to increase the excitement of the game. The play of the Over-Under game cannot possibly affect decisions to be made in the play of the Twenty-One game as the Over-Under game is completed when the first two cards are dealt. Play of the Twenty-One game cannot either influence the play of the Over-Under game or vice versa.

U.S. Pat. No. 5,839,730 describes a side bet game that may be included with the play of a game of Twenty-One. A player makes a side bet that certain predetermined arrangements of cards or events will occur, with the player receiving special bonuses or jackpots when those events occur. For example, the player's side bet wager may cover such predetermined arrangements of cards or events such as any pair, any pair of the same suit, cards of the same suit, pairs of 2's, pairs of 3's, straights, flushes, runs of 2's and 3's as described in U.S. Pat. No. 5,839,730 and the like. An important consideration in the design of the side bet game to be played in combination with the play of a game of Twenty-One is to have the play of the side bet game irrelevant to the play of a game of Twenty-One. For example, if a jackpot is won when a player obtains six consecutive deuces, every player with a knowledge of the probabilities in the play of Twenty-One would be likely to continue taking hits on a count of 10 with five straight deuces, whether or not the side bet was in play with the game of Twenty-One. The game is specifically designed so that the player will not be required to choose a playing strategy that is inconsistent with the generally accepted strategy of the base game.

Many variations in the play of poker-type games have also been introduced to increase the excitement and interest in the play of both table and video versions of poker. For example, in a video version of draw poker, U.S. Pat. Nos. 5,356,140 and 5,531,440 teach that after an initial wager, two distinct hands may be dealt, and the player may select between the two hands for continued play of the game. Only a single hand may be played.

Similarly, U.S. Pat. No. 5,816,915 describes a video poker gaming apparatus in which multiple hands are displayed on a screen and each of the hands is partially revealed (e.g., 1 or more cards, but less than all cards are displayed). The player then elects which one of the multiple displayed hands is to be played, and the draw poker game or stud poker game for that one hand proceeds to a resolution. Again, only a single hand of poker is player.

U.S. Pat. No. 5,863,041 describes Pai Gow Poker with an auxiliary game. In the ordinary play of Pai Gow Poker, seven cards are dealt to a player, and the player divides the hand into a five-card poker hand and a two-card poker hand. Each of the hands made by a player must beat equivalently created hands (five and two-card hands) dealt to the dealer. In addition to the normal play of Pai Gow Poker, a player has the option of placing a bonus bet. The bonus bet encompasses the attainment of hands of a predetermined rank and the award of bonuses for attaining those hands after the bonus bet.

U.S. Pat. Nos. 5,265,882; 5,395,120 and 5,702,104 teach a casino table card game apparatus and play in which each player's position is provided with three distinct card playing areas or lines. Cards are dealt to a player so that each player may play at least two distinct card games (e.g., from among Twenty-One, modified Draw Poker, and Baccarat). A player makes a first bet in at least two of the different player positions, and cards are dealt to each of those player positions. Different games are played with each separate set of hands, and the play of one game does not directly influence or affect the play of any other game.

Similarly, U.S. Pat. No. 5,639,092 describes a method of playing a casino table game having multiple casino games. Each player position is provided with distinct playing positions for the different games (such as blackjack, roulette, baccarat, poker and jackpot).

U.S. Pat. Nos. 5,494,295 and 5,697,614 describe a casino table card game and apparatus in which a player may select any number of predetermined hand ranking rules to apply to the play of a hand. A player is dealt an initial, partial hand, and the player then elects from that initial hand which set(s) of predetermined hand ranking rules apply to the hand. In a preferred game, the dealer receives two separate bank hands, one that utilizes the hand ranks of standard poker and one that utilizes the hand ranks of low-ball poker. Once each player has received four of his five cards, each player decides which of the dealer's two hands to play against, with the option of playing against both (as in selecting both ways in a Hi-Low poker game). Then each player receives their fifth, and last, card. At this point, the "bank" hands are exposed and each player's hand is compared to the specific "bank" hand, or hands, that they played against, winners are determined, and wagers are settled. The election of playing against a high rank hand, low rank hand or both ways, does not alter the strategy or selection of cards, as only the hand dealt to the player is utilized, without any replacement of cards coincident with play strategy.

U.S. Pat. No. 5,664,781 describes a method and apparatus for playing a poker-type card game. A number of different stud poker hands are dealt on a playing surface and players wager as to which will have the highest stud poker ranking. Game options include choosing the hand with the lowest rank instead of the highest rank. As each hand is fixed and there are no replacement cards, there can be no play of one hand that is influenced by the play of another hand.

U.S. Pat. No. 5,377,993 teaches a form of Twenty-One in which the player's hand and the dealer's hand may be combined after play of the Twenty-One game to try to achieve a predetermined poker hand rank. As the play of the underlying game of Twenty-One is completed before the poker game is initiated, the play of the poker game cannot influence the play of Twenty-One or vice-versa. U.S. Pat. No. 5,288,082 describes a method of playing double hand Marquez, a game in which multiple hand versions of Twenty-One are played with individual players being dealt five cards, the five cards being divided into a two-card front hand and a three-card back hand. The cards in the front hand and the back hand are arranged to make each hand as close to twenty-one as possible, without going over, while at the same time maximizing the value of the front hand with respect to the back hand so that the value of the front hand has a value closer to twenty-one, without exceeding twenty-one. The front hand of the bank player is compared to the front hand of the player and the back hand of the bank player is compared with the back hand of the player, respectively, to determine if the player wins or loses the hand. The play of the cards is intended to be automatic, with no skill involved, and the play of one hand should not interfere with the play of the other hand.

In summary, it is desired to find a game that is easy to play and also fast moving. When the player is provided with a considerable amount of participation, and additional winnings based on card combinations not related to the base game, these games become much more strategic and enjoyable. Furthermore, a game is more exciting if a player feels anticipation and excitement from a number of different sources throughout the game.

SUMMARY OF THE INVENTION

In the play of a hand of poker (either as a casino table card game or a video gaming apparatus or computer game), a partial hand is provided to a player after an initial wager. The actual hand of poker involves the potential for at least two distinct games of poker being playable from that partial hand. The player may then elect to play one or more of the potential games from the at least two distinct games of poker playable with that partial hand. The nature of the at least two distinct games is that at least two of the games which may be played from the partial hand require decisions to be made where a decision with a selection of play strategy in one poker game that is intended to have a positive outcome is likely to have a negative effect or comprises an adverse strategy in the play of the second game. Various pay tables are provided that differ from each other, with respect to each or one single game, depending upon whether the player elects to play a single game with the partial poker hand or elects to play at least two games with continued play of the partial poker hand.

DETAILED DESCRIPTION OF THE INVENTION

There are many different formats for the play of the card game known generically as poker. The many variations include the number of cards initially dealt and the number of cards used in the final play of the game, the types of hands and ranks of hands that are determined to be winners or of relatively different rank than other hands, whether wild cards may be used, whether cards may be discarded and replaced, betting or wagering sequences, and the like. Although to the casual player or novice poker may seem to be a game where winners are lucky and happen to get the best cards, the game involves very subtle exercises in probabilities and statistics in the play of a hand. Depending on the specific cards held in a hand, the exposed played cards known to a player, and the payouts for specific hands, a player may exercise various strategies to maximize the likelihood of winning or the likelihood of attaining a particularly valuable final hand in the play of a game. The specific strategies used to improve a hand in one game can be adverse to the specific strategies that would be useful in another and different poker game. As in conventional poker, players seek to obtain predetermined arrangements of cards having standard poker rankings, including a Royal Flush, straight flush, four-of-a-kind, fullhouse, flush, straight, three-of-a-kind, two pairs or a pair.

Figure 1:
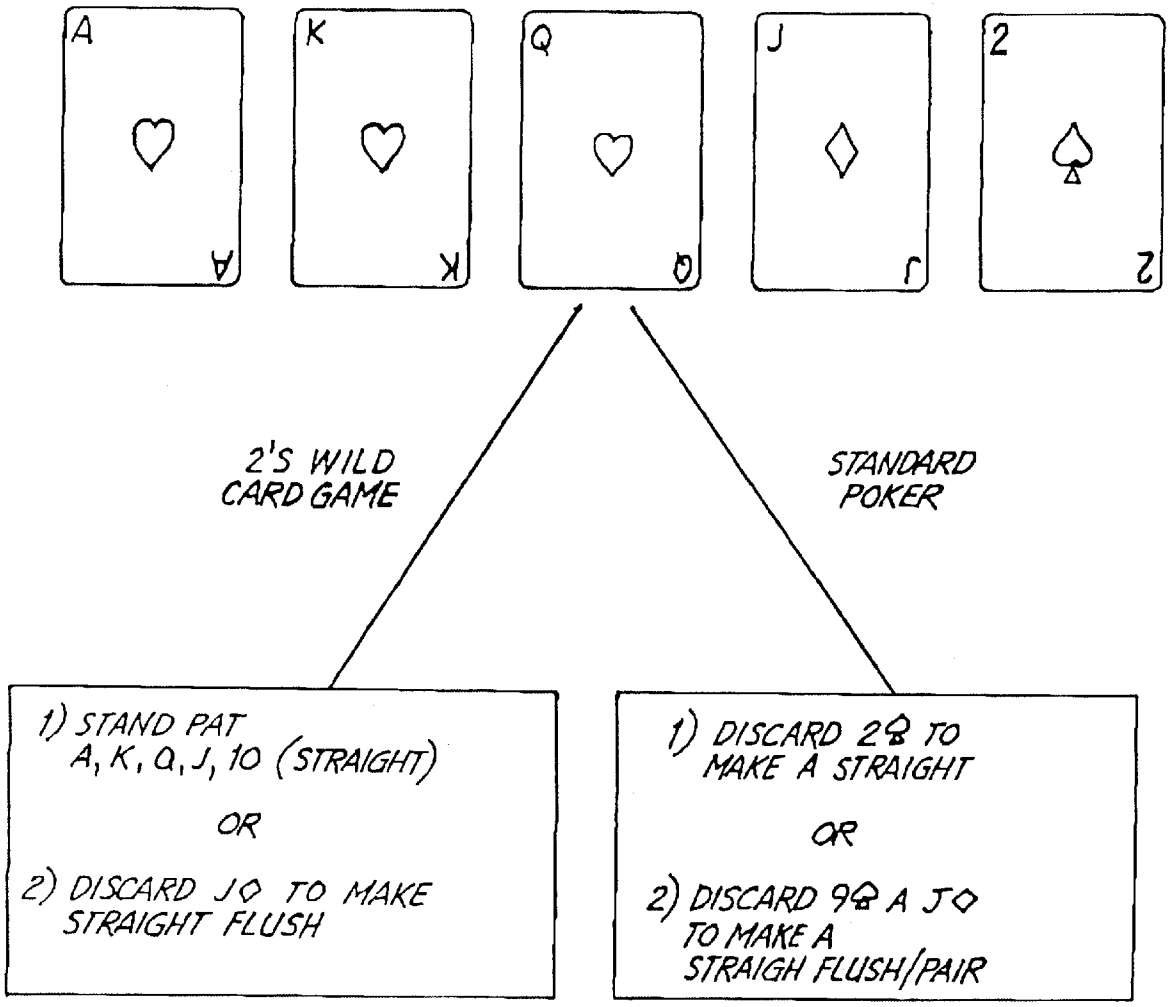
FIGS. 1 and 2 shows a partial poker hand with two different strategies of play shown for the hand.

Looking at two specific poker games will assist in the appreciation of the distinctive strategies that might be available in a single hand. The simplest basis of comparison would be in two five card draw games where there is a wild card (e.g., any deuce) in one game and no wild cards in the other game. If a partial hand (or initial hand) of five cards is dealt to a player, and there are two distinct games available in subsequent play, the player has to decide between two opposing strategies. For example, as shown in FIG. 1, if the initial hand were A-K-Q of Hearts, J of Diamonds and the 2 of clubs, there are clearly disparate options available to the player in the two different stud games. In the wild card game, the player has the options of standing pat with a straight or discarding the Jack of Diamonds in the hope of receiving another deuce or the Jack or Ten of Hearts. The latter option is more than a reasonable play since the payout for a Royal Flush is usually quite high, and this particular draw allows for five different cards out of forty-seven remaining cards to complete the straight flush. In addition, eight other cards (the 2–9 of Hearts) would complete a flush and two other Jacks and three other tens would complete a straight. Therefore eighteen out of forty-seven cards would either significantly improve the hand or maintain its approximate payout level. That is a reasonable strategy in view of the relative payouts for the other potential hands, even while putting the payout for the straight at risk.

With the other potential play of the hand, the five card draw poker game with no wild card, the strategy of the play of these particular cards would be significantly different. The only reasonable strategies in the play of those cards with no wild cards would be to discard the deuce (looking for a straight or a match with either the A, K, Q or J to get a pair) or to discard the Jack and the deuce (looking for the J-10 of Hearts for a Royal Flush, any Jack-10 for a Straight, two Hearts for a flush, or any number of A's, K's or Q's for a pair, two pair or three of a kind). As can be seen, the most reasonable strategies for the two different games are quite distinct. Even though the play or strategy in the wild card game could include the discard of the Jack and deuce, hoping for a natural Royal Flush which may have a higher payout, unless the larger pay out is significant (e.g., at least about twenty times greater), there is no reasonable benefit to the play. If the same hand were played out a statistically significant number of times, the player would win significantly more by standing pat or discarding only the Jack in the wild card game, then discarding both the Jack and deuce.

The player may elect to play both games with a single hand. In the play of this particular hand, the player, depending upon what the payout tables are for playing one game versus two games, may find the allure of playing both games simultaneously very attractive. For example, if the payout tables provided for significantly increased payouts when both games are played with the single hand, the player may elect to play a strategy in one game that appears unreasonable. For example, if there were a progressive jackpot for playing both hands and getting a straight flush or Royal Flush, the player might elect to play both games with the described hand and discard both the Jack of Diamonds and the Deuce of Clubs, hoping for the Jackpot.

The rules of play of a game or both games in a set of at least two possible games that could be played from a single hand can also determine the strategies or possibility of playing both hands. For example, depending upon the structuring of low hands in Low-Ball poker, it might be absurd to consider that a player would play both normal five card draw and Low-Ball with the same initial hand. In most games of Low-Ball, for example, a perfect Low hand would be A-2-3-4-6 of different suits. It is therefore not possible to play both a high card format of draw poker and a Low-Ball format of draw poker where the Low hand must be completely worthless in the play of a normal rank play of draw poker. However, if modifications were made in the rules of the Low-Ball game, there could be strategies of play that would influence a player to play both a high rank format of draw poker and Low-Ball poker at the same time. For example, if flushes were not included in consideration of a Low-Ball hand or if an A-2-3-4-5 straight were defined as the perfect Low-Ball hand (which is played in some house rules), then a player might well consider playing a single hand in both games, even where the strategy in one game would be contrary to a traditional strategy in that game. For example, where a hand of Ace-2-3-5 of Hearts and A of Diamonds was dealt, the traditional strategy would be to discard either the Ace of Diamonds or the 2-3-5 of Hearts. In playing both Low-Ball poker and high rank draw poker or only Low-Ball poker, the only choice is to discard the Ace of Diamonds. The potential for different games and different awards, with different rules of play, therefore clearly affects the strategy of the game. The events are still random, but the strategy is altered by the ability to play different games with the same cards.

It is an essential element of the double game structure of the present invention that the difference in strategy between the two games and therefore the selection of play of both games requires that a player choose a playing strategy that is inconsistent with the generally accepted strategies of at least one of the two games. That is, there must be a line of play available for choice for optimizing the return in the play of at least two games that is inconsistent with a basic strategy that would be used to produce the maximum return in at least one of the at least two games. An available line of play or strategy that may be used in the play of one of the at least two games will typically be a strategy that could be used to maximize a return in the play of that game, but because of the fundamental differences between the two games, that available line of play will be inconsistent with a strategy that would be used for at least one game of the at least two games that may be played with the initial hand. This concept has been thoroughly exemplified above and is readily understood by the ordinarily skilled artisan. It should be understood that a line of play that is inconsistent with maximizing a return on a hand in one game is not limited to a strategy that would totally destroy any potential for a return on that game. As noted above, discarding a deuce and a necessary card (the Jack) from a wild card supported straight is not a typical strategy, but where the play of two hands offers the opportunity of a large bonus with unusual play, such a strategy is reasonable.

Figure 2:
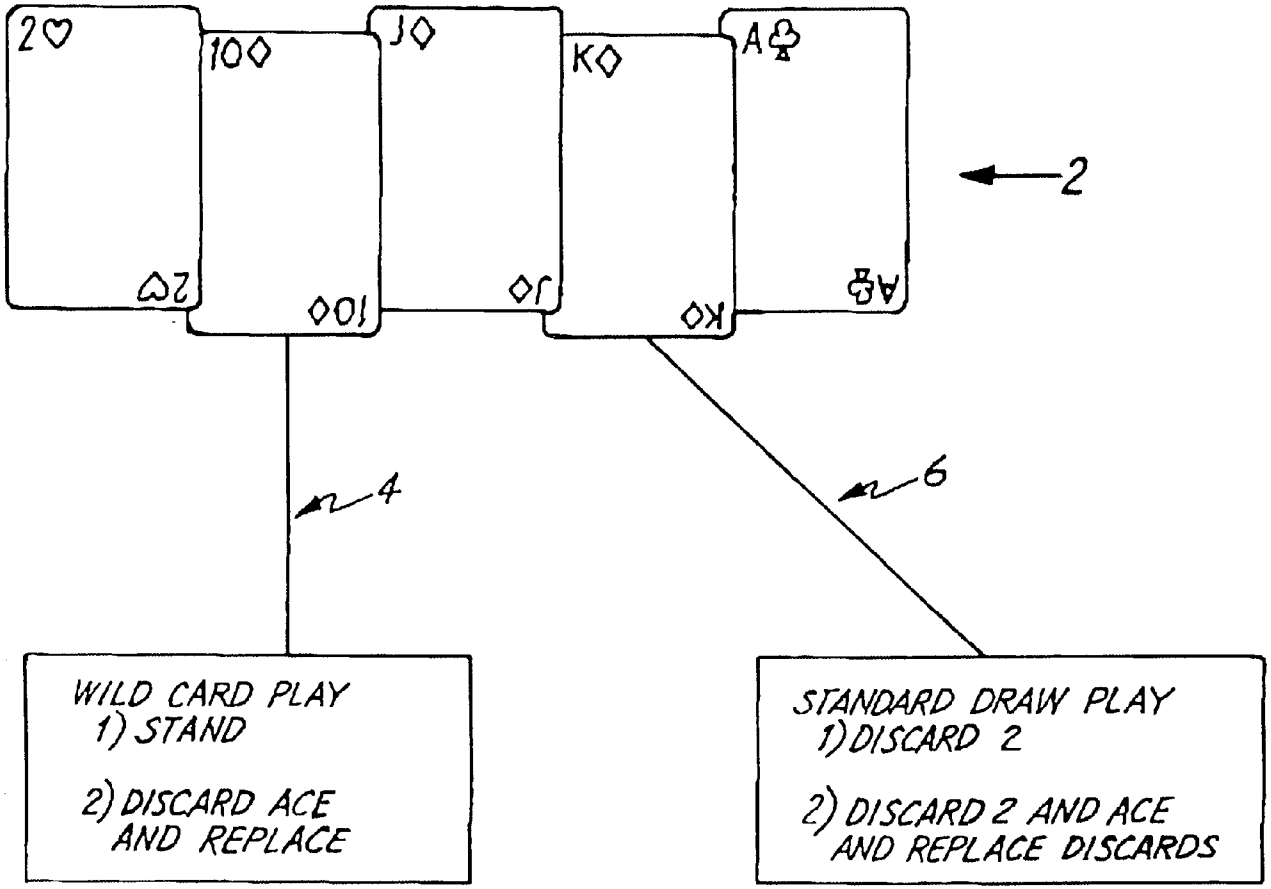

The clear difference in strategies available in different games, the conflict in strategies, and the need to select a strategy in the play of one game versus the strategy in another game that may be played with the same initial hand is clearly demonstrated by FIG. 2. An initial hand 2 is shown consisting of the 2 of Hearts, Ten and Ace of Clubs. The two games available for play in this game are Deuces Wild Poker and Standard Five Card Draw poker, with the objective of each game being to attain the highest poker ranked hand. The reasonable strategies available are clearly dependent upon the nature of the game that is selected to be played, and as shown in this example, there is no rational basis for even an overlap in strategies for some hands. For the play of the Wild Card game of poker, the only reasonable strategies 4 would be to stand (with a straight) or discard the Ace of Clubs in the hope of receiving a Nine, Queen or Ace of Diamonds (resulting in a straight flush or Royal Flush), any other Diamond suited card, a second deuce, a Queen or an Ace. It is possible to consider discarding the Wild Card (the deuce) in the hope of receiving the specific diamonds necessary for a straight flush or Royal Flush, but that would be an extreme and non-standard strategy of play, as the probabilities of that occurrence are so low that over a statistically significant repeated play of this hand, that strategy would loose significant money. In the play of the Standard Five Card draw poker, the reasonable strategy path available 6 would consist of discarding the deuce (since it is not a Wild Card) and discarding both the deuce and the Ace, the latter being the better strategic path because of the much higher payout for straight flushes and Royal Flushes versus filling an inside straight by discarding only the deuce. As can be seen from this review, there are clear and antagonistic strategies for the play of the various different games, and those strategies are in clear conflict with each other when certain groups of cards are drawn.

The concept of opposed strategies is easy to understand by way of example, and should be considered in the following light. Where there are two different games that may be played with the initial hand, there are usually multiple reasonable options of play available with each type of game. The options are selected on the basis of the fact that, given a statistically significant number of recurrences of the same hand and random replacement of discarded cards, the selection of an option is performed on the basis of providing the statistically largest return on that hand by that play. In the consideration of reasonable strategic options, only the two highest statistically beneficial strategies should be considered for each game. Game strategies are in conflict where at least one strategy in each of the at least two available game options are not included in the first two strategically beneficial options of play for both games. It is more desirable and an objective of the game where, considering the first two strategic options available in each game, there are two non-shared strategic options, three non-shared strategic options, or four non-shared strategic options, as shown in the analysis of FIGS. 1 and 2. It is to be understood that for a given pair of games, the strategies will not always conflict and need not always conflict, but the possibility for significant conflict in the play of the games must exist. For example, if the games are deuces wild draw poker and standard draw poker, there would be no conflict in strategy for the play of the single hand for the two games if a natural Royal Flush were dealt. The strategy for both games would be the same, to stand pat with the dealt hand.

The game may be played in number of different manners, and the following examples are to be considered non-limiting examples, with other variations being obvious to those of ordinary skill in the art.

In this example, wild card five card draw poker (deuces wild) is used in combination with standard five card draw poker. The object of the game is to attain a hand of at least a predetermined value (e.g., a pair of Jacks or better in the standard draw game returning 1:1 on the initial wager), with higher level hands providing higher multiple returns on the initial wager. The wild card draw game (as is typical with wild card games) returns payouts only with higher value hands (e.g., two pair returns 1: 1, and higher rank hands return higher multiple payouts). The games can also be played as stud poker games. After a first wager, an initial set of five cards may be dealt to each player. The player examines the playing hand and makes a determination as to whether that initial hand has a greater likelihood of success in playing only the wild card draw poker game or the standard draw poker game, or if the initial hand has a potential for a significant win playing both games simultaneously with the single hand. Upon making a determination of the direction of play that appears desirable, the player may then indicate the direction of play intended, and the player will then stand pat with that play, or elect to take an allowed number of replacement cards, discarding cards that are though to be relatively undesirable for the direction of play intended. The wagering on the game and the payout schedules may take any of a number of designed formats. Each of these will be discussed separately.

Wagering Formats

A first wager must be made by each player at the beginning of each game, before the entire initial hand has been revealed to the player, and usually before the cards have been dealt or any of the player's cards revealed to the player. In a video version of the game, this can be readily done by inserting a coin or token of the appropriate amount for the desired wager into an acceptor or slot, or by betting credits that have been earned or purchased before the start of the game. The player then examines the dealt cards that form the initial hand and considers the options available, which include playing the hand for only one available game format, or playing the hand for two or more available game formats. If additional wagers or bets are available, the player may also be afforded the opportunity to fold or surrender the first wager, without continuing play of the hand. For example, the play of two hands may proceed by merely pressing an appropriate button on a video apparatus or placing of the initial hand in an appropriate location on the table. The rules may allow the decision to be made without any further wagering, or may require a wager (of an amount less than, equal to, or greater than the first wager) to proceed in any specific direction of play. For example, with video gaming apparatus, the initial wager may be one (1) dollar, and the election to play both games may require (a) no wager, (b) a second wager that is less than the first wager, for example $0.25, (c) a second wager that is equal to the first wager, or (d) a second wager that is greater than the first wager (e.g., $2). It would be most typical in the play of a single game that there be no additional wager, as the typical video gaming draw poker game is played. The player then would indicate (by pressing the appropriate buttons) which mode of play is intended, whether a single game, at least two games, or a fold. The player would then select cards that are to be discarded and randomly replaced. This procedure would be similar to the standard methodology of play in video gaming draw poker apparatus used commercially. For example, the cards to be replaced or the cards to be retained would be highlighted by the player, and then the player would activate a discard and random replacement function in the apparatus to discard and replace those cards. The dealer or gaming apparatus would then consider the directed play of the game (which game or games were selected) and then identify winning combinations of cards, and then resolve the wager (s). In one preferred embodiment, the player places only one wager, and the play of both games simultaneously is mandatory.

The Pay Tables

As previously indicated, the pay tables may be constructed to influence the desirability of playing certain strategies in the selection of the number of games played. This can be done by weighting the payout tables in whatever direction increased play is sought. For example, the following tables might be considered to be neutral with respect to the selection of individual games:

FIVE CARD DRAW POKER

| Rank of the Poker Hand | Payout on a One Dollar ($1) Wager |
|---|---|
| Less Than a Pair of Jacks | 0 |
| A Pair of At Least Jacks | $1 |
| Two Pairs | $2 |
| Three-of-a-Kind | $3 |
| A Straight | $4 |
| A Flush | $5 |
| Full House | $8 |
| Four-of-a-Kind | $25 |
| Straight Flush | $100 |
| Royal Flush | $1000 |

WILD CARD FIVE CARD DRAW

| Rank of the Poker Hand | Payout on a One Dollar ($1) Wager |
|---|---|
| Less Than a Pair of Jacks | 0 |
| A Pair of At Least Jacks | 0 |
| Two Pairs | $1 |
| Three-of-a-Kind | $2 |
| A Straight | $3 |
| A Flush | $3 |
| Full House | $5 |
| Four-of-a-Kind (With Wild Cards) | $10 |
| Four-of-a-kind (No Wild Cards) | $20 |
| Straight Flush (With Wild Cards) | $25 |
| Straight Flush (No Wild Cards) | $75 |
| Royal Flush (With Wild Cards) | $250 |
| Royal Flush (No Wild Cards) | $1000 |

Where there is an option to play two games at the same time, with strategies that are not compatible, the pay table on each of the games may be the same, higher, lower, partially higher, partially lower, or partially higher and partially lower. In a preferred embodiment, the payouts are higher for each hand in one game or each game when the player elects to play both hands simultaneously. What is meant by "partially higher" would be where all payouts were the same from Full Houses down in poker rank hands, but there would be higher payout for Straight flushes and Royal flushes. For example, when a player elects to play both games, the payout for a straight flush with wild cards for the Wild Card game may be increased to $100. A special Jackpot may also be available where cards are drawn in the play of at least two games and a Royal Flush without Wild Cards is obtained. This could be a progressive jackpot (as commonly played with single or grouped video gaming apparatus, and as played with certain casino table card games) or a fixed amount jackpot (e.g., $100,000). What is meant by "partially lower" is that all payouts for one or both of the chosen games no higher than or would be lower than all of the payouts for the ranked hands when a single game was chosen for play. For example, the pay table shown above for five card draw (Without Wild Cards) would be identical except that there would be a zero payout for all pairs. The pay table for the Wild Card game could be similarly or differently skewed.

The terminology partially higher/partially lower (and the like) means that, when the play of at least two strategically different games are selected for play with a single hand, certain payout values within at least one pay table are higher and certain payout values are lower. For example, a mixed or partially higher/partially lower pay table for the Wild Card Draw Poker Game, when a player elects to play at least two strategically different poker games with the same hand could be:

WILD CARD FIVE CARD DRAW

| Rank of the Poker Hand | Payout on a One Dollar ($1) Wager |
|---|---|
| Less Than a Pair of Jacks | $0 |
| A Pair of At Least Jacks | $0 |
| Two Pairs | $0 |
| Three-of-a-Kind | $1 |
| A Straight | $ |
| A Flush | $1 |
| Full House | $5 |
| Four-of-a-Kind (With Wild Cards) | $10 |
| Four-of-a-Kind (No Wild Cards) | $20 |
| Straight Flush (With Wild Cards) | $25 |
| Straight Flush (No Wild Cards) | $75 |
| Royal Flush (With Wild Cards) | $500 |
| Royal Flush (No Wild Cards) | $1500 |

The video gaming apparatus for the play of this double play or double pay poker type game would consist of relatively conventional video gaming apparatus with software and play/activating buttons modified specifically for the features of the game. For example, a housing could contain any combination of the following, with certain elements clearly being essential or combinable with functions, such as a video monitor, coin acceptor (token acceptor or credit card scanner or paper currency acceptor), cash out button, credit wagering button, highlighting button (s) for each card, format of play indicator button(s), coin return tray, permanent pay table indicia, credit display, assistance light, jackpot indicators (e.g., lights, music, strobes), auxiliary video display, memory unit, computer hardware, specialized software, central reporting capability, anti-tampering alarms, and the like.

Figure 3:
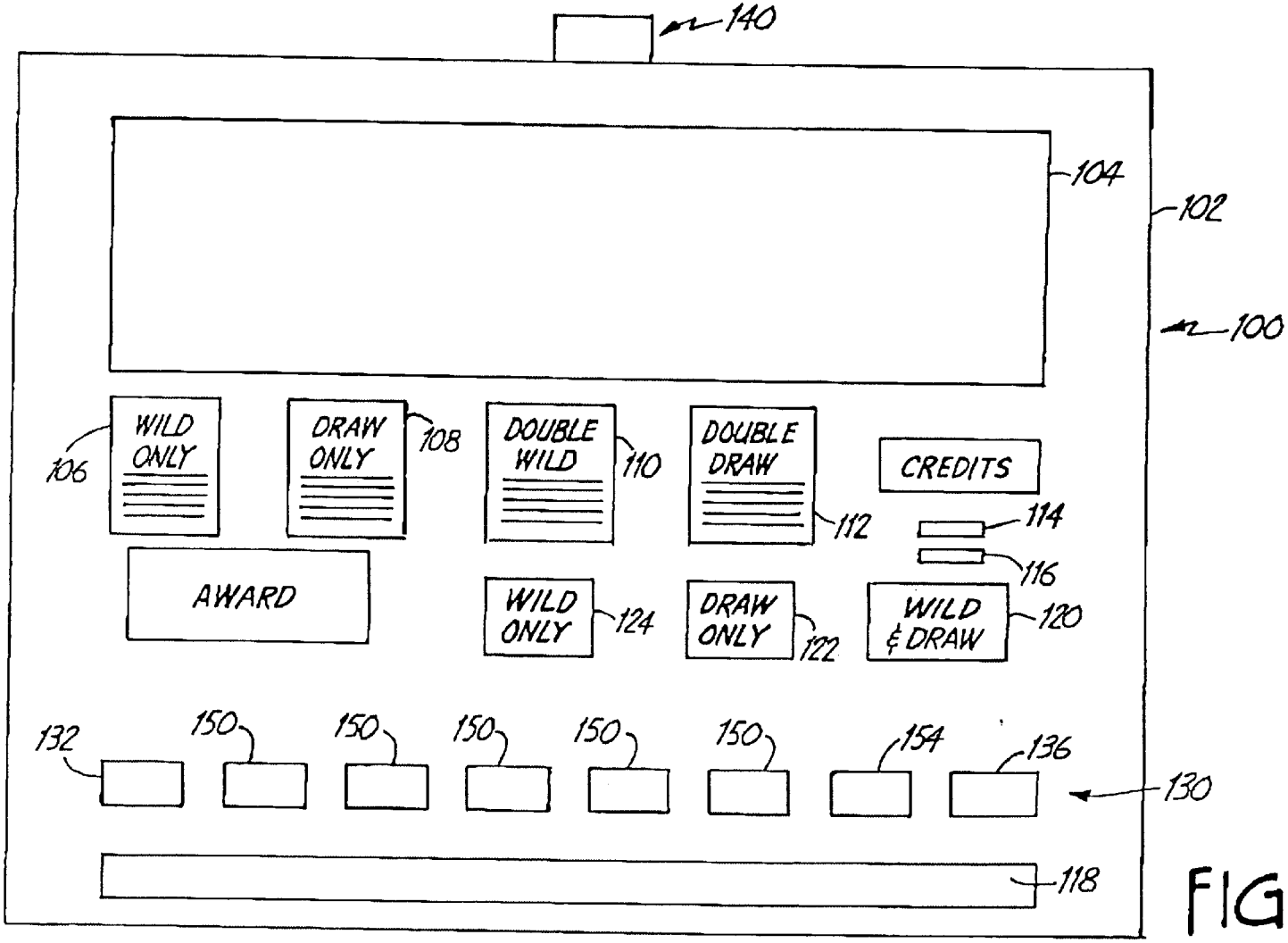
FIG. 3 shows a video gaming apparatus that may be used to implement video gaming play of the invention.

FIG. 3 shows a video gaming apparatus 100 that may be used to implement video gaming play of the invention. The video gaming apparatus 100 comprises a housing 102 having a display screen 104, a series of four pay tables 106 108 110 and 112 showing the pay tables for playing the Wild Card game only 106, the Draw Poker game only 108, the play of the Wild Card poker game when playing two games 110, and the play of the Draw Poker game when playing two games 112, respectively. The apparatus is provided with a credit card or paper currency receptor 114 and a coin acceptor 116, as well as a return payout tray 118. Three separate activator buttons or selection buttons 120 122 and 124 are shown for engaging the options of Wild Card play only, Draw Poker only, or both Wild Card and Draw Poker play, respectively. These options may be combined in a single button, requiring only different numbers of contacts through the button to differentiate the options. A series 130 of activator or signaling buttons are shown. These buttons may provide such various functions or signals such as cash out 132, hold or discard buttons 150 for respective cards shown on display screen 104, wager one token button 154 and wager the maximum credits button 136. Other optional standard, specialty or desirable features such as assistance light 140 may also be provided.

What is claimed is:

1. A method of playing a wagering poker-type game comprising:

at least one player placing a wager to play in two mandatory poker type games;

only players being provided with a number of card symbols as an initial hand with which to play two mandatory poker-type game; and each player continuing play of the two mandatory poker-type games with the initial hand, wherein each player may be required to choose a playing strategy for at least a first mandatory poker-type game that is inconsistent with the generally accepted strategy of play for a second mandatory poker-type game.

2. The method of claim 1 wherein the player places one wager for the two mandatory poker-type games.

3. The method of claim 1 wherein separate payouts are made for at least a first poker-type game and for a second poker-type game.

4. The method of claim 1 the two mandatory poker-type games comprise draw poker and wild card poker.

5. The method of play of claim 1 wherein a first pay table for payouts to the player for ranked poker hands is provided for a first mandatory poker-type game, and a second pay tale for a second mandatory poker-type game defines payouts to the player on the second mandatory poker-type game which are different than the payouts to the player for ranked poker hands in the first poker-type game is elected.

6. The method of play of claim 2 wherein a first pay table for payouts to the player for ranked poker hands is provided for a first mandatory poker-type game, and a second pay tale for a second mandatory poker-type game defines for payouts to the player on the second mandatory poker-type game which are different than the payouts to the player for ranked poker hands in the first poker-type game is elected.

7. The method of play of claim 3 wherein a first pay table for payouts to the player for ranked poker hands is provided for a first mandatory poker-type game, and a second pay tale for a second mandatory poker-type game defines payouts to the player on the second mandatory poker-type game which are different than the payouts to the player for ranked poker hands in the first poker-type game is elected.

8. The method of play of claim 4 wherein a first pay table for payouts to the player for ranked poker hands is provided for a first mandatory poker-type game, and a second pay tale for a second mandatory poker-type game defines payouts to the player on the second mandatory poker-type game which are different than the payouts to the player for ranked poker hands in the first poker-type game is elected.

9. The method of play of claim 5 wherein a first pay table for payouts to the player for ranked poker hands is provided for a first mandatory poker-type game, and a second pay tale for a second mandatory poker-type game defines payouts to the player on the second mandatory poker-type game which are different than the payouts to the player for ranked poker hands in the first poker-type game is elected.

10. The method of claim 1 wherein said first and second poker-type game are selected from the group consisting of draw poker, wild card poker, and Low-Ball poker.

11. The method of claim 3 wherein said first and second poker-type game are selected from the group consisting of draw poker, wild card poker, and Low-Ball poker.

12. The method of claim 4 wherein said first and second poker-type game are selected from the group consisting of draw poker, wild card poker, and Low-Ball poker.

13. The method of claim 5 wherein said first and second poker-type game are selected from the group consisting of 5 card draw poker and 5 card wild card poker.

14. The method of claim 6 wherein said first and second poker-type game are selected from the group consisting of 5 card draw poker and 5 card wild card poker.

15. The method of claim 8 wherein said first and second poker-type game are selected from the group consisting of 5 card draw poker and 5 card wild card poker.

16. The method of claim 9 wherein said first and second poker-type game are selected from the group consisting of 5 card draw poker, 5 card wild card poker, and 5 card Low-Ball poker.

17. A video gaming apparatus for the play of poker-type games comprising:

a housing;

a video screen;

a computer; and software, wherein the software provides data:

to be displayed on the video screen of an initial hand;

requiring a player to play different poker-type games with the initial hand, where the player may be required to choose a playing strategy for at least a first poker-type game that is inconsistent with the generally accepted strategy of play for a second poker-type game.

18. The video gaming apparatus of claim 17 wherein said poker-type games are selected from the group consisting of 5 card draw poker, 5 card wild card poker, and 5 card Low-Ball poker.

19. The apparatus of claim 17 wherein said software identifies poker ranks of hands and provides awards depending on the rank of poker hands according to the different poker-type games.

20. A method of playing a wagering game, comprising:

placing a wager to participate in at least one poker-type game;

the player being required to simultaneously play more than one poker-type game with the same hand of cards, wherein a game playing strategy for playing at least one hand of similar poker-type games according to the game rules for the similar poker-type games is in conflict;

dealing the player a hand of cards; and awarding the player a prize for obtaining a predetermined arrangement of cards.

21. The method of claim 20, wherein the first poker-type game is deuces wild draw poker and the second poker-type game is draw poker.

22. The method of claim 21 wherein the a first mandatory poker-type game is wild draw poker and a second mandatory poker-type game is draw poker.

23. The method of claim 20 wherein the player plays two poker-type games, and a hand of cards dealt to the player requires the player to choose a playing strategy for at least one poker-type game being played that is inconsistent with a generally accepted strategy for play of the other poker-type game.

24. The method of claim 20 wherein separate pay tables are provided for each individually played poker-type game.

25. The method of claim 20 wherein the poker-type games are selected from the group consisting of draw poker, stud poker, wild card poker, and Low-Ball poker.

26. The method of claim 20 wherein the poker-type games are selected from the group consisting of five card draw poker and five card wild card poker.

27. A method of playing a wagering game, comprising:

placing a wager to participate in at least two simultaneously played mandatory poker-type games;

the player playing the poker-type games with the same hand of cards, wherein a game playing strategy for playing at least one simultaneous hand of cards according to conventional game play strategy for the similar poker-type games is in conflict;

dealing the player a hand of cards; and awarding the player a prize for obtaining a predetermined arrangement of cards in each of the mandatory simultaneously played poker-type games.

28. The method of claim 27, wherein the at least two poker-type games comprises deuces wild draw poker and conventional draw poker.

29. The method of claim 27 wherein the at least two poker-type games comprises deuces wild stud poker and conventional stud poker.

30. The method of claim 28 wherein the dealing step comprises dealing a partial hand of cards to the player, and further comprising the step of placing an additional wager after the partial hand of cards is dealt.

31. The method of claim 27 wherein at least one hand of cards dealt to the player requires the player to choose a playing strategy for at least one poker-type game being played that is inconsistent with a generally accepted strategy for play of the other poker-type game.

32. The method of claim 27 wherein separate pay tables are provided for each poker-type game.

33. The method of claim 27 wherein a single pay table is provided for each poker-type game.

34. The method of claim 27 wherein the poker-type games are selected from the group consisting of draw poker, wild card poker, and Low-Ball poker.

35. The method of claim 27 wherein the poker-type games are selected from the group consisting of five card draw poker and five card wild card poker.

* * * * *